US005088395A

United States Patent [19]

Schlottke

[11] Patent Number: 5,088,395

[45] Date of Patent: Feb. 18, 1992

[54] TOOL FOR TENSIONING AND CUTTING OFF A TAPE LOOP PLACED ABOUT AN OBJECT

[75] Inventor: Horst Schlottke, Tangstedt, Fed. Rep. of Germany

[73] Assignee: Paul Hellermann GmbH, Pinneberg, Fed. Rep. of Germany

[21] Appl. No.: 458,705

[22] PCT Filed: Jul. 22, 1988

[86] PCT No.: PCT/EP88/00662

§ 371 Date: Jan. 23, 1990

§ 102(e) Date: Jan. 23, 1990

[87] PCT Pub. No.: WO89/01227

PCT Pub. Date: Feb. 9, 1989

[30] Foreign Application Priority Data

Jul. 24, 1987 [DE] Fed. Rep. of Germany ..... 8710185

[51] Int. Cl.[5] ..... B65B 13/34

[52] U.S. Cl. ..... 100/30; 100/33 R; 140/93.2; 140/123.6

[58] Field of Search ..... 100/8, 29, 30, 32, 33 R; 29/509, 522.1; 24/16 PB; 140/93 A, 93.2, 123.6

[56] References Cited

U.S. PATENT DOCUMENTS

| | | | |
|---|---|---|---|
| 3,101,663 | 8/1963 | Hall et al. | 100/30 |
| 3,154,114 | 10/1964 | Bailey . | |
| 3,489,076 | 1/1970 | Countryman | 100/30 X |
| 3,570,554 | 3/1971 | Kabel | 100/29 X |
| 3,670,782 | 6/1972 | Kabel | 140/93.2 |
| 3,672,295 | 6/1972 | Weller | 100/30 X |
| 3,698,310 | 10/1972 | Plattner et al. | 100/30 X |
| 4,610,067 | 9/1986 | Hara | 140/93 A X |
| 4,763,700 | 8/1988 | Hidaka et al. | 140/93.2 |

FOREIGN PATENT DOCUMENTS

| | | | |
|---|---|---|---|
| 889672 | 1/1972 | Canada | 140/93.2 |
| 1279801 | 10/1968 | Fed. Rep. of Germany . | |
| 2558794 | 8/1985 | France . | |

*Primary Examiner*—Harvey C. Hornsby
*Assistant Examiner*—Stephen F. Gerrity
*Attorney, Agent, or Firm*—Chilton, Alix & Van Kirk

[57] ABSTRACT

Tool for tensioning and cutting off a tape loop (2) placed about an object (17), the ends (3A, 3B) of the tape loop being led through a lock (7) which serves for their connection. One end (3B) of the loop is initially connected to a tape supply. The tool forms a support (5) for the lock (7), an opening (1) in the lock support for the passage of the tape ends (3A, 3B), a tensioning device for the tape end connected to the tape supply, a support for the free tape end and a cutting device (13). The invention achieves a simplification of the construction of the tool and a processing of the tape with no waste by the support device comprising a clamp (11) pressing the free tape end (3A) on one side against the other tape end (3B) supported by an abutment (4) and the cutting device (13) being arranged on the side of the clamp (11) facing away from the lock support (5).

14 Claims, 1 Drawing Sheet

TOOL FOR TENSIONING AND CUTTING OFF A TAPE LOOP PLACED ABOUT AN OBJECT

Figure 1:
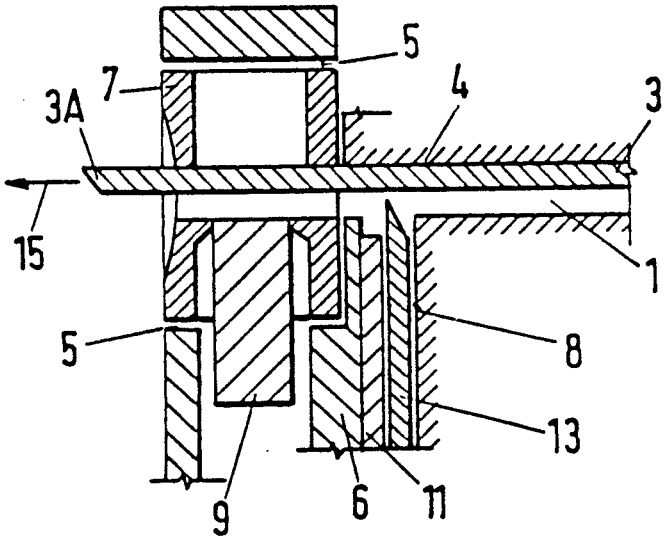

The invention relates to a tool for tensioning and cutting off a tape loop placed about an object, the ends of which tape loop are led through a lock provided for their connection and one of which is connected to a tape supply, the tool comprising a support for the lock, an opening in the lock support for the passage of the tape ends, a tensioning device for the tape end, connected to the tape supply, a cutting device and a support device for the free tape end, which is formed from a clamp pressing the free tape end on one side against the other tape end supported by an abutment of the tool.

In a known tool of this type (DE-B-1,279,801), the cutting device is arranged directly behind the lock support, so that the tape ends projecting from the lock can be cut off as short as possible. This has the disadvantage that not only the tape end which is to be tensioned and which is connected to the tape supply must be cut off, but the free tape end must also be cut off so that waste pieces occur. However, in many forms of application (for example in aircraft construction), the occurrence of waste is unacceptable because it could cause damage at other points.

In such cases, those cable tapes whose tape is connected integrally to the head are therefore used (U.S. Pat. No. 3,154,114), and the cutting off of the protruding tape end is dispensed with, although this is also undesired. In so far as a cutting device for cutting off the protruding tape end is provided in tools for processing such one-piece cable tapes (U.S. Pat. No. 3,154,114), this cutting device is also arranged directly behind the head support, in order to ensure a small protrusion of the cut-off tape end out of the head. Cable tapes designed in one piece have the fundamental disadvantage that, because of the greater use of material, they are more expensive than those which consist of a section of an endless tape and special heads.

The object of the invention is to provide a tool of the type mentioned in the introduction which enables the processing of cable tapes using an endless tape without the occurrence of waste.

The solution according to the invention consists in arranging the clamp directly behind the lock or the lock support and the cutting device on the side of the clamp facing away from the lock support.

This solution allows the free tape end to end directly behind the clamp and in front of the cutting device so that no part of it has to be cut off and consequently no waste occurs either.

The cutting off of a tape end is only effective when the remainder left at the head is very short. Otherwise, it could cause a risk of injury because of its sharp cutting edge. It could not be expected that a tape end could be cut off to a sufficiently short length by the arrangement according to the invention. Conventional support devices for supporting the free tape end indeed have a considerable length in the direction of the tape extension. This is because they are given dimensions so as to completely absorb the maximum tensioning force. The invention has recognized that this is not necessary because of a peculiar effect. This is because when—as assumed by the invention—the free tape end is pressed by the support device against the tape end which is to be tensioned and which is connected to the tape supply, the maximum tension to be withstood by the clamp at the free tape end only occurs when the tape end to be tensioned is drawn in the tensioning direction and when a friction force is consequently exerted on the free tape end by the tape end to be tensioned, which reduces the supporting force required for securing the free tape end.

It is on the basis of this inventive recognition that an especially small clamping device, which is short in the tape direction, can be used, only a small distance between the lock and the cutting device being necessary for its accommodation. The cutting device can therefore be arranged on the side of the support device facing away from the lock and the cutting effect can be limited to the tape end connected to the tape supply. The occurrence of waste at the free tape end is thereby avoided.

The clamp is advantageously designed in the form of a thin leaf, in order to limit the unavoidable protrusion of the tape out of the lock to a minimum. For the same reason, the blade of the cutting device is arranged at a small distance behind the clamp or even directly adjacent to it in a common guide. controlling the clamp, the control cylinder being temporarily secured by means of a mechanical locking device until the clamping position of the tape end has been reached in order to then be released and moved abruptly with full force into the clamping position.

The invention is described in more detail below with reference to the drawings.

Figure 2:
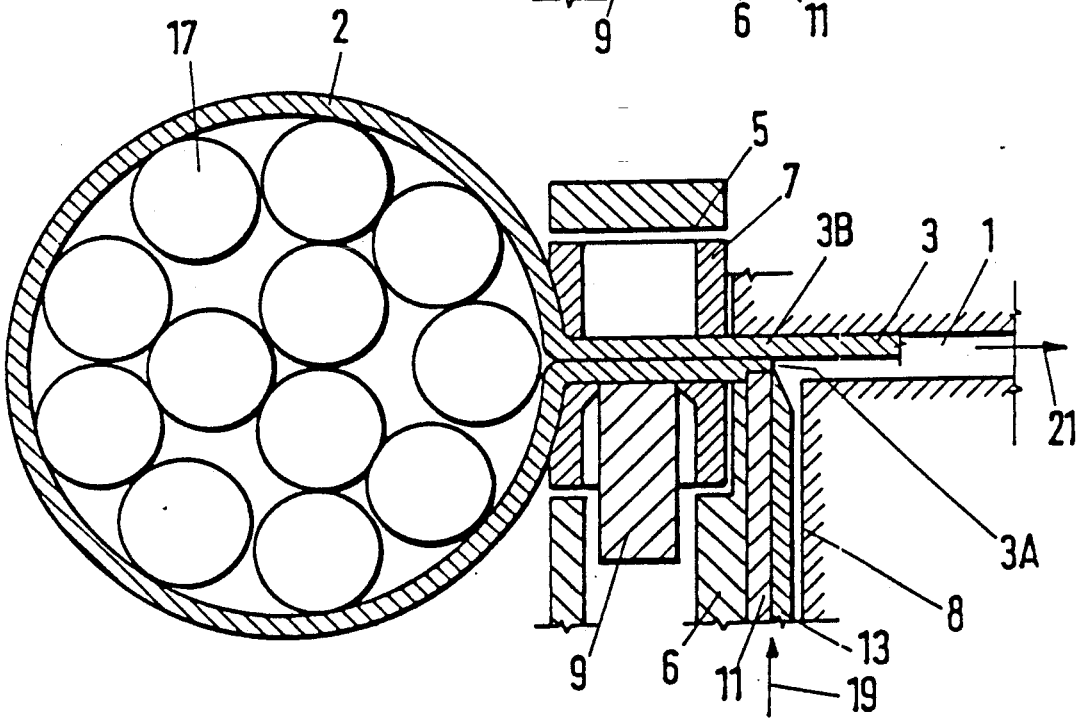
Figure 3:
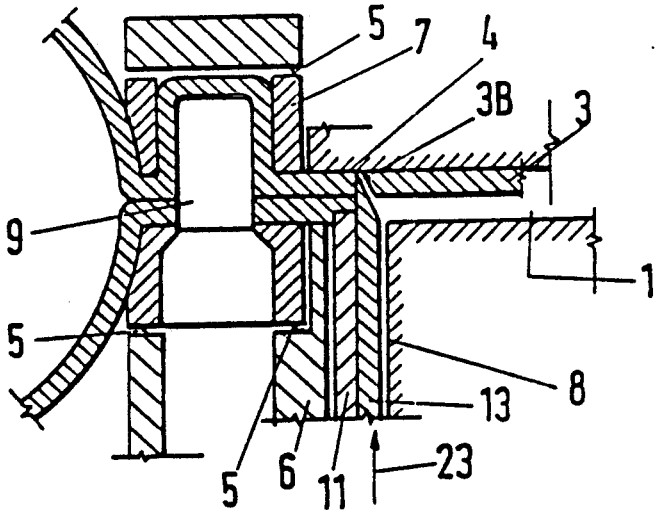

FIGS. 1 to 3 show a diagrammatic representation of a part of the tool in three different embodiments.

The principle of the construction of the tape and lock, of the construction of the tool and of the binding method conforms to the state of the art in accordance with DE/PS 1,279,801. The cable tape forms a loop 2, whose ends 3A and 3B are secured in the lock 7 by means of a pin 9.

The tool contains a support for a tape supply, not shown, and a guide channel 1 for the tape 3, which guide channel in the front of the tool in a support 5 for the lock 7 opens flush with the tape opening provided in the lock so that the tape end 3A fed through the guide channel 1 passes through the lock, is placed about the object to be bound—a cable form 17 in the example shown —and is fed back through the lock opening into the guide channel 1 of the tool again.

The guide channel 1 forms an abutment 4 near its end on the side of the opening, on its side situated at the top in the drawing, associated with the tape end 3B connected to the tape supply. On the opposite side, directly behind the lock support 5, a lamellar clamp 11 is provided which, together with the blade 13 of the cutting device, can be displaced transversely to the guide channel 1 in arrow direction 19 in a guide which is formed on the one hand from the plate 6 of the lock support and on the other hand from a guide edge 8 of the tool body. The clamp is connected to a drive, not shown, which, when the tool has its automatic embodiment, can be formed by a pneumatic control cylinder. In the state of rest the clamp 11 is drawn back counter to the arrow direction 19 out of the guide channel 1. In the active position, it can be pushed forward in arrow direction 19 and pressed against the free tape end 3A (FIGS. 2 and 3).

In the position of rest, the blade 13 of the cutting device projects into the guide channel 1 in accordance with FIG. 1, but leaves sufficient space for the tape end 3B which is to be tensioned and which is connected to the tape supply. By means of a drive, not shown, it can be moved in arrow direction 23 against the abutment 4 in order to cut off the tape end 3B to be tensioned (FIG. 3).

The tool is used as follows.

The free end 3A of the tape 3 is led in accordance with arrow 15 through the guide 1 and through the opening of the lock 7 (FIG. 1), placed about a cable bundle 17 situated in front of the tool and introduced again into the guide 1 through the lock 7 until it bears against the blade 13 forming a stop. This placing about can be carried out by hand using hand-operated tools. However, the invention can also be applied to automatic tools in which the tape 3 is placed automatically about the cable bundle 17. As soon as the free end 3A bears against the blade 13, the clamp 11 is moved in the direction of the arrow 19 and the free end 3A of the tape 3 is pressed against the adjacent end 3B which is supported against the abutment 4 as a result of the clamping force. The tape end 3B is then drawn back in the direction of the arrow 21 in order to tension the loop 2 about the cable bundle 17 thereby. This is possible because the adjacent upper surfaces of the tape are smooth and the abutment 4 is also designed to have low friction, for example as a plane metal surface. On the other hand, the end surface of the clamp 11 can (but does not have to) be designed to have a high degree of friction. After a predetermined tension has been reached, the pin 9 is pressed into the lock 7. By deep-drawing in the tape ends which are clamped and have a tensile force applied to them, the pin thereby forms a bowl-shaped material area which extends into the upper bore and the blade 13 is pressed in accordance with arrow 23 against the tape end 3B and the tape 3 is thus cut off without waste (FIG. 3).

The introduction of the tape 3, the placing about the cable bundle 17, and the movements of the clamp 11, of the knife 13 and the drawing back of the tape 3 are advantageously pneumatically controlled. In this case a reduction in the working time can be achieved by admitting pressurized air into the pneumatic control cylinder of the clamp 11 even during the tape feed and securing the control cylinder temporarily by means of a mechanical locking device until the tape band 3A has reached the clamping position. In this way, the control cylinder can be filled with pressurized air even during the tape feed and its control speed is increased after the release of the mechanical locking device.

In a simplified embodiment of the tool, the clamp 11 and the blade 13 can be designed as a single clamping and cutting member which, outside the rest position, has two working positions, the first of which is a clamping position and the second a cutting position. In the clamping position, the cutting edge of the blade is in the position in which the clamp 11 works in the figures, pressed against or into the free tape end, without severing the latter. During the movement into the cutting position, a very small piece of the free tape end, as well as the tape end connected to the supply reel, are cut off. In this case, a stationary edge or the like, arranged behind the blade, is provided as a stop for the free tape end. If this edge is arranged very close to the clamping and cutting member, the waste arising as a result can be maintained at such a low level that it causes no damage or can be easily collected in the tool.

I claim:

1. A tool for tensioning, locking, and cutting off a tape loop (2) placed about an object (17), comprising:

a support (5) for a lock (7), an opening in the lock support for the passage of the tape free end from a tape supply behind the support, out of the opening and around the object in front of the support, and back into the opening in overlapping relation with a trailing portion of the tape, a tensioning device for the trailing portion of the tape while the tape is connected to the tape supply, clamp means (11) for pressing the free tape end (3A) and overlapping trailing portion (3B) against an abutment (4) associated with the tool, a cutting device for cutting the trailing portion while the free end is clamped thereto, wherein the clamp means is arranged directly behind the lock support (5) and the cutting device (13) is arranged behind the clamp means (11).

2. The tool according to claim 1, characterized in that the clamp means (11) is in the form of a thin leaf.

3. The tool according to claim 1, characterized in that the cutting device has a blade and the blade (13) is arranged at a small distance behind the clamp (11) means.

4. The tool according to claim 3, characterized in that the clamp means includes a rigid member movable transversely to the tape free end, and the blade (13) of the cutting device interacts with the same abutment (4) as the rigid member.

5. The tool according to claim 4, characterized in that a common guide (8) is provided for the clamp rigid member (11) and for the blade (13) of the cutting device.

6. The tool according to claim 1, characterized in that a stop for the free tape end (3A) is provided behind the clamp means (11).

7. The tool according to claim 6, characterized in that the cutting device includes a blade (13) which forms the stop for the free end (3A) of the tape.

8. The tool according to claim 6, characterized in that a feed device with a sliding clutch is provided for the free tape end.

9. The tool according to claim 1, characterized in that an automatic control for the tool is provided.

10. The tool according to claim 9, characterized in that pressurized air is admitted during the tape transport into a pneumatic control cylinder present for controlling the clamp, the control cylinder being temporarily secured by means of a mechanical locking device until the clamping position of the tape end has been reached.

11. A tool for tensioning, locking and cutting off a tape loop around an object, the loop having a leading portion free end overlapping a trailing portion connected to the tape supply, comprising:

a lock support having front and back portions traversed by the overlapping tape and adapted to support a lock member during attachment of the lock member to the overlapping tape;

a guide passage between the lock support and tape supply, for guiding the trailing portion of the tape from the tape supply into the lock support and receiving the overlapped free end of the leading portion of the looped tape from the lock support;

means for drawing the trailing portion of the tape toward the tape supply;

means behind the lock support for clamping together the overlapped tape in the passage while the trailing portion is drawn and while the lock member is attached to the overlapped tape; and means behind the means for clamping, for cutting through the trailing portion of the tape adjacent to the tape free end after the lock has been attached.

12. The tool according to claim 11, characterized in that the means for clamping includes means for holding the free end stationary while the overlapping portion is drawn over the free end away from the object as the means for drawing pulls the trailing portion toward the tape supply.

13. The tool according to claim 12, characterized in that the means for clamping includes a stationary abutment and a clamp member movable transversely to the tape toward the abutment.

14. The tool according to claim 13, characterized in that the abutment has a smooth surface whereby the overlapped portion can be drawn along the smooth surface while the free end is held stationary by the means for clamping.

* * * * *